US007451695B2

(12) United States Patent
Palamides et al.

(10) Patent No.: US 7,451,695 B2
(45) Date of Patent: Nov. 18, 2008

(54) APPARATUS FOR PRESSING SHEET-LIKE PRINTED PRODUCTS

(75) Inventors: Stefano Palamides, Weil der Stadt (DE); Johannes Oldenkott, Althengstett (DE); Wolfgang Pfeiffer, Stuttgart (DE)

(73) Assignee: Palamides GmbH, Renningen (DE)

( * ) Notice: Subject to any disclaimer, the term of this patent is extended or adjusted under 35 U.S.C. 154(b) by 236 days.

(21) Appl. No.: 10/964,242

(22) Filed: Oct. 13, 2004

(65) Prior Publication Data

US 2005/0098050 A1 May 12, 2005

(30) Foreign Application Priority Data

Oct. 16, 2003 (DE) ..... 103 48 900

(51) Int. Cl.
*B30B 3/04* (2006.01)
*B65H 29/20* (2006.01)

(52) U.S. Cl. ..... 100/176; 100/161; 100/163 R; 100/168; 100/172; 226/187; 271/273; 271/314; 270/32; 270/58.01

(58) Field of Classification Search ..... 100/155 R, 100/159, 160, 161, 162 R, 163 R, 164, 163 A, 100/167, 168, 169, 170, 171, 172, 176; 226/177, 226/186, 187 X, 194 X, 194, 187; 271/272, 271/273 X, 273, 314; 19/105; 270/32, 58.01
See application file for complete search history.

(56) References Cited

U.S. PATENT DOCUMENTS 3,200,446 A * 8/1965 Dausch ..... 19/267
3,661,383 A * 5/1972 Morrison ..... 271/273
4,211,165 A * 7/1980 Schill ..... 100/162 R
5,542,349 A 8/1996 Gösslinghoff
5,953,985 A * 9/1999 Kobayashi ..... 101/116
2001/0011408 A1* 8/2001 Exner ..... 19/105

FOREIGN PATENT DOCUMENTS

| | | | |
|---|---|---|---|
| DE | 295 07 466 U1 | | 8/1995 |
| DE | 4 325 343 C2 | | 12/1997 |
| EP | 0 654 434 A1 | | 5/1995 |
| FR | 960352 | | 1/1948 |
| GB | 2 121 009 A | | 12/1983 |
| JP | 02138072 A | * | 5/1990 |
| JP | 03293243 A | * | 12/1991 |

* cited by examiner

*Primary Examiner*—Jimmy T Nguyen
(74) *Attorney, Agent, or Firm*—Harness, Dickey & Pierce, P.L.C.

(57) ABSTRACT

An apparatus serves for pressing sheet-like printed products, in particular for pressing folded printed products. The apparatus has a first pair of pressing rollers, with a first, lower pressing roller and a second, upper pressing roller. A further pair of pressing rollers arranged downstream has a third, lower pressing roller and a fourth, upper pressing roller. A drive for driving the pressing rollers is also provided. It is proposed that one pressing roller of each pair of pressing rollers can be moved away from, and toward, the other pressing roller via a mechanism.

6 Claims, 3 Drawing Sheets

APPARATUS FOR PRESSING SHEET-LIKE PRINTED PRODUCTS

CROSS-REFERENCE TO RELATED APPLICATION

This application claims priority to German Patent Application No. 103 48 900.2 filed Oct. 16, 2003, which application is herein expressly incorporated by reference.

BACKGROUND OF THE INVENTION

The invention relates to an apparatus for pressing sheet-like printed products, in particular folded printed products, having a first pair of pressing rollers, with a first pressing roller and a second pressing roller, and having at least one further pair of pressing rollers, which is arranged downstream of the first pair of pressing rollers and has a third pressing roller and a fourth pressing roller, and having a drive mechanism for driving the pressing rollers.

Such an apparatus serves for pressing sheet-like printed products such as brochures, periodicals, flyers, in particular folded products, to form a flat body.

The intention is for such printed products to be stacked one upon the other for transportation or the like and to be bundled, stowed and transported as compact stacks which require as little space as possible.

It has been found that in particular folded printed products enclose considerable quantities of air between the pages, this air resulting in unnecessarily high and often uneven stacks during the stacking operation.

This is sometimes aggravated in that, in particular in the case of relatively stiff materials, the sheets which have been folded over along a folding edge tend to unfold.

Tests to press such a stack in a stacking apparatus have shown that it is relatively difficult for the air between the folded-over pages or the air between the individual printed products to be removed quickly in a short period of time.

The known pressing apparatuses are located upstream of the stacking apparatus in order for enclosed air to be pressed out and for the individual printed product to be pressed into a flat product which is as compact as possible.

It has become established practice for this to be carried out by two pairs of pressing rollers arranged one behind the other.

During operation the pressing rollers become contaminated. In particular if the printing on the printed products is still very fresh, printer's ink gets deposited on the surface of the pressing rollers. It is equally possible for bits of material emanating from cutting operations or other machining operations to settle on the surface of the pressing rollers.

In the case of a known apparatus, the two pairs of pressing rollers are designed as pairs of pressing rollers arranged one above the other and the two pairs of pressing rollers butt directly against one another. Since it is necessary for the distance between the pressing rollers of a respective pair to be adjusted dependent on the thickness of the printed product and for at least one roller of a pair of pressing rollers to be mounted in a resiliently or damping manner, in order to damp impacts which occur, for example, when passing over a folding edge, it has become established practice to arrange the respectively lower pressing roller of the pair of pressing rollers in a stationary manner and to provide the respectively upper pressing roller, which can be adjusted to a slight extent, with a resilient or damping member.

For reasons of accessibility, these components have been arranged on the top side of the uppermost pair of pressing rollers.

As will readily be understood by those skilled in the art, the term "drive belt(s)" as used herein and in the claims, refers to any type of endless drive member, including belts, chains, or cables.

This then results in the pressing rollers being barely accessible for cleaning purposes, with the need that the pairs of pressing rollers have to be dismantled for a cleaning operation.

This is very time-consuming and, following assembly, it is necessary to readjust the correct position of the pressing rollers.

It is therefore object of the present invention to provide an apparatus of the above mentioned type whose rollers can be cleaned easily.

SUMMARY OF THE INVENTION

This object is achieved according to the invention in that one pressing roller of each pair of pressing rollers can be moved away from, and toward, the other pressing roller via a mechanism to an extend access for a cleaning process is achieved between a pair of rollers.

The provision of the mechanism makes it possible to move the individual pressing rollers of a respective pair away from one another, with the result that all the pressing rollers are easily accessible for a cleaning operation.

Once the cleaning operation has been carried out, the pressing rollers are moved back into the original position again by the mechanism, with the result that there is no need for any time-consuming readjustment work.

This increases the effectiveness of such an apparatus to a considerable extent. It should be remembered that such printed products have to be processed in large numbers in the shortest possible period of time. A typical case is feeding a flyer, folded once, for an advertising brochure, for example, to a magazine or a daily newspaper with runs of several hundred thousand copies.

In a further embodiment of the invention, in which the apparatus has pairs of pressing rollers with pressing rollers arranged one above the other, it is provided that the respectively upper pressing roller can be raised up from the lower pressing roller.

This measure has the advantage that, for example, a person who is standing up can easily access the pressing rollers for cleaning purposes.

In a further configuration of the invention, the movable pressing rollers of the different pairs of pressing rollers can be moved together.

This measure has the advantage that the movable pressing rollers, that is to say the pressing rollers which can be raised or raised up, are raised up together, as a result of which the mechanism is simplified and all the pressing rollers are then simultaneously accessible for a cleaning operation.

Provision may also be made for these raising-up operations to be carried out independently of one another. The first pair of pressing rollers becomes contaminated more frequently than one or more pairs of pressing rollers arranged downstream.

In a further embodiment of the invention, the drive is designed such that the pressing rollers can be driven both when they have been moved away from one another and when they are butting against one another.

This measure has the considerable advantage that, in the state in which they are being separated from one another, the pressing rollers can still be driven, that is to say rotated, which markedly simplifies the cleaning operation. The person carrying out the cleaning thus gains gradual access to the entire circumferential surface of each pressing roller.

In a further configuration of the invention, the movable pressing rollers are supported by a pivotable lever.

This measure has the advantage, on the one hand, that a mechanically robust and simple configuration of the mechanism is possible. In addition, a simple pivoting movement makes it possible for one movable pressing roller or also all of the movable pressing rollers at the same time to be moved away from the others.

In a further embodiment of the invention, the drive mechanism has drive belts which are guided around a pivoting journal of the pivotable lever.

This measure has the advantage that, by virtue of this drive-belt guidance, the pressing rollers supported by the pivotable lever can be driven in any desired pivoting position, i.e. in a pressing position and in any raised cleaning position.

In a further embodiment, a first drive belt drives the non-movable pressing rollers, and a second drive belt drives the movable pressing rollers.

This measure has the advantage that mounting, inspection and also, if appropriate, repair of the roller arrangement is simplified.

In a further embodiment of the invention, the non-movable pressing rollers are mounted in a resilient manner.

This measure then makes it possible, in particular in the case of pressing rollers which are arranged one above the other and in the case of which the movable pressing rollers are located at the top of a pair of rollers, to provide the lower, stationary pressing rollers with resilient or damping mechanism. The resilient or damping mechanisms can be arranged beneath the pressing rollers located at the bottom.

This facilitates not just assembly, but also the cleaning operation, since the raised-up pressing rollers are connected to only a small number of additional necessary components.

In a further embodiment of the invention, the movable pressing rollers can additionally be displaced relative to the pivotable lever by a lifting mechanism.

This measure has the advantage that the necessary adjustment to the distance of the two pressing rollers of a pair of pressing rollers in relation to one another for adaptation to different thicknesses of printed products is carried out by the lifting mechanism.

This lifting mechanism may, at the same time, be coupled to the pivoting mechanism or be part of this mechanism, with the result that the design of the apparatus is simplified overall, which then also inevitably helps simplify the cleaning operation.

The invention is explained and described in more detail hereinbelow with reference to a embodiment and in connection with the attached drawings, in which:

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
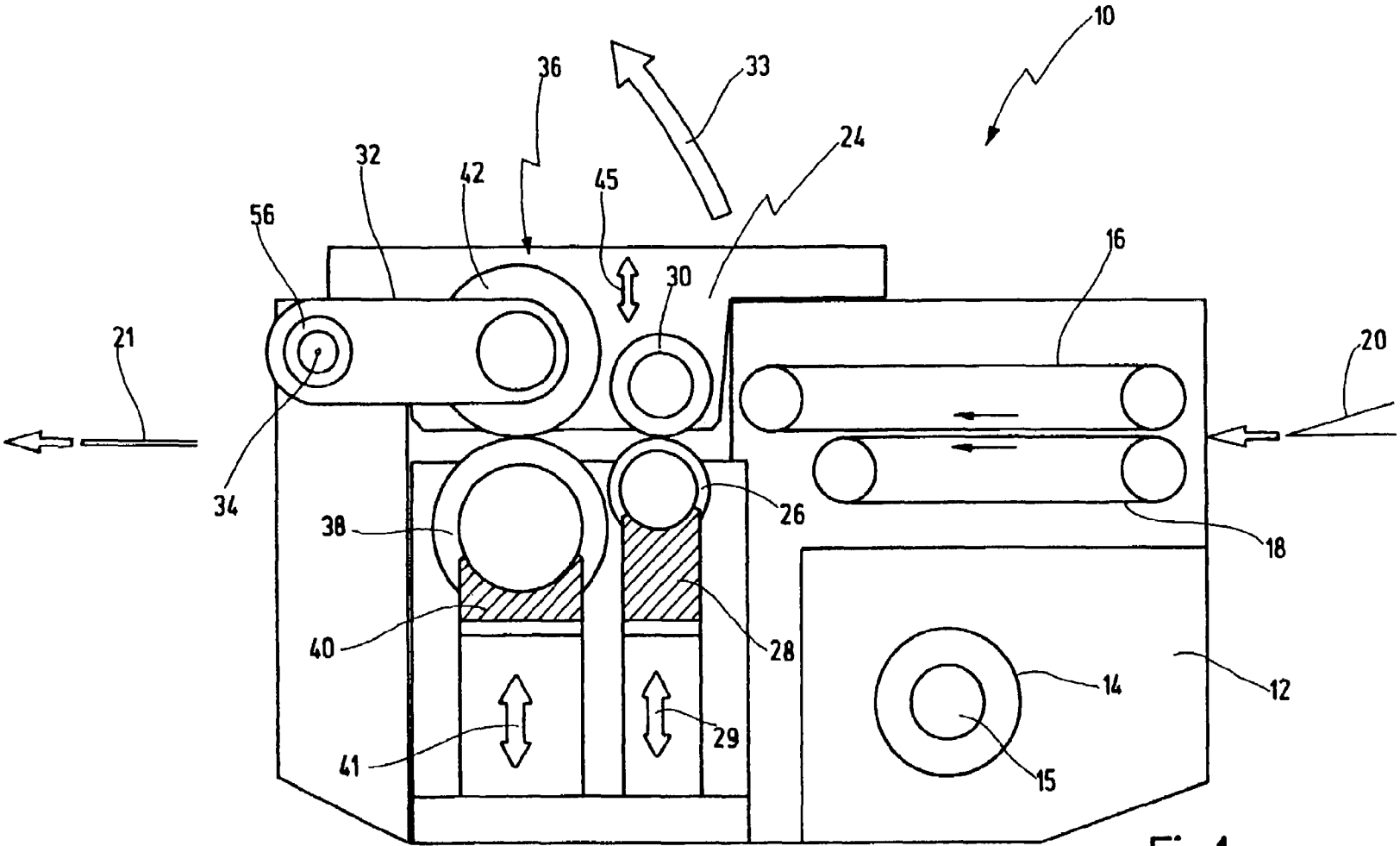
FIG. 1 shows, in highly schematic form, a side view of an apparatus according to the invention for pressing sheet-like printed products in an operating state intended for pressing purposes.
Figure 2:
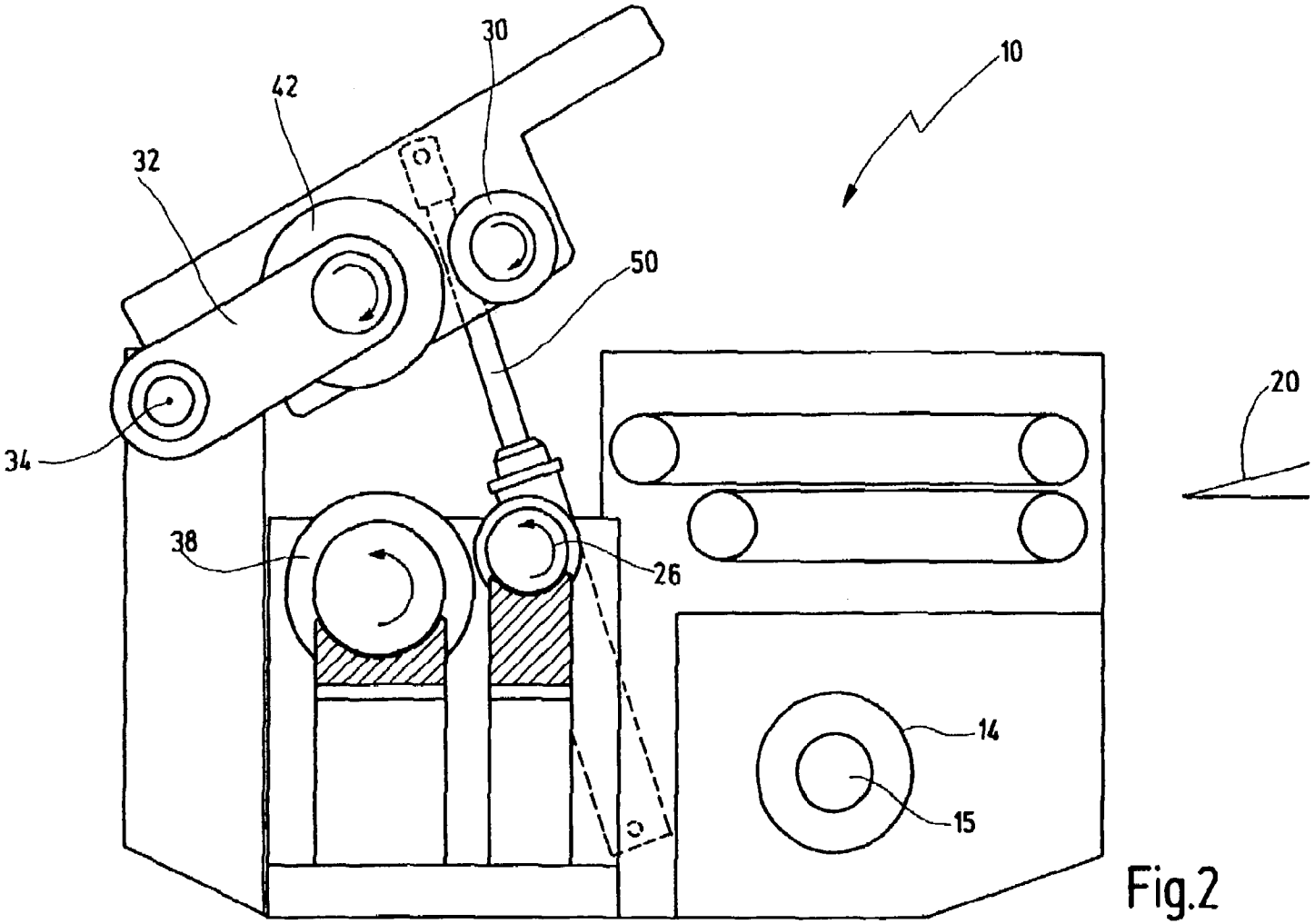
FIG. 2 shows the apparatus from FIG. 1 in an operating state intended for cleaning the pressing rollers.

An apparatus 10 for pressing sheet-like printed products 20 is shown in FIGS. 1 and 2.

The apparatus 10 has a housing 12 which accommodates a drive mechanism 14.

The drive mechanism 14 is designed as an electric motor from which a journal 15, which serves as a drive journal, projects.

Arranged in the region of the drive mechanism 14 and thereabove are two endless belts 16 and 18 which serve for drawing in a printed product 20 which has been folded and not yet pressed, and for feeding this product to the actual pressing operation.

For this purpose, a first pair 24 of pressing rollers is arranged in the region of the transporting end of the endless belts 16 and 18.

The first pair 24 of pressing rollers comprises a first, lower pressing roller 26, which is mounted in a bearing block 28. The pressing roller can be rotated and is supported resiliently for damping purposes, which is indicated by a double arrow 29. A bearing supporting the pressing roller 26 is mounted on the top of a piece made of a resilient material for example rubber.

A second, upper pressing roller 30 is arranged directly above the first, lower pressing roller 26. This second, upper pressing roller 30 is supported in a rotatably mounted manner by a pivotable lever 32.

The pivotable lever 32 can be pivoted about an axis 34, as is indicated by an arrow 33.

The two endless belts 16 and 18 are arranged such that they guide the folded, but not yet pressed, printed product 20 between the first pair 24 of rollers.

A second pair 36 of pressing rollers is arranged immediately downstream of the first pair 24 of pressing rollers.

The further pair 36 of pressing rollers has a third, lower pressing roller 38, which is likewise mounted in a rotatable and resilient manner in a bearing block 40, as indicated by a double arrow 41.

The second pair 36 of pressing rollers has a fourth, upper pressing roller 42, which is likewise mounted in a rotatable manner in the pivotable lever 32. The second pair 36 of pressing rollers is arranged such that the pressing plane thereof is located approximately at the same height as that of the first pair 24 of pressing rollers.

The first pair 24 of pressing rollers has pressing rollers 26, 30 with a somewhat smaller diameter than the pressing rollers 38, 42 of the second, further pair 36 of pressing rollers.

The first pair 24 of pressing rollers serves as a type of pre-press, in order to force out most of the quantity of air which is contained between the sheets of the printed product 20, which is folded in an approximately V-shaped manner.

The second pair 36 of pressing rollers arranged downstream, which exerts a higher pressure, serves for removing residual air altogether and also for folding again the folding edge to give a pressed printed product 21. The two sheets of product 21 are pressed closely against one another without any inclusions of air being present therebetween.

This gives rise to adhesion forces between the two sheets which ensure that the pressed printed product 21 no longer unfolds.

The printed product 21 which has been pressed in this way may then be fed, for example, to a stacking device in order for a plurality of such pressed printed products 21 to be stacked one upon the other, if appropriate bundled for further processing or for transportation.

FIG. 2 shows a situation in which the pivotable lever 32 is raised up, that is to say pivoted upward about the axis 34, via a piston/cylinder unit of the mechanism 50.

Since the pivotable lever 32 bears the respectively upper pressing rollers 30 and 42, these upper pressing rollers have been raised up from the respectively lower pressing rollers 26 and 38 by this pivoting operation.

By virtue of this straightforward raising-up operation, all four pressing rollers are then accessible for a cleaning operation.

This cleaning operation, then, is additionally facilitated in that it is also possible in the raised-up state, that is to say the state which is shown in FIG. 2, for all four pressing rollers to be rotated by the central drive 14, with the result that the entire outer surface of the four pressing rollers is accessible for cleaning purposes.

In order to be able to adjust the distance between the individual pressing rollers of a pair of pressing rollers in the operating position illustrated in FIG. 1, in order for it to be possible to adjust it to different thicknesses of a printed product 20 which is to be pressed, a lifting mechanism is additionally provided. The pressing rollers 30 and 42 which are supported by the pivotable levers can be moved along double arrow 45 in a certain distance by this lifting mechanism. The lifting mechanism contains a piston arrangement located within the pivotable lever 32, which pistons move a bracket supporting the rollers 30 and 42 relatively to the lever 32.

This lifting range is approximately 0,1 to 1 inch and serves merely for adaptation the distance of the two rollers of a pair to the thickness of the printed product 20.

Figure 3:
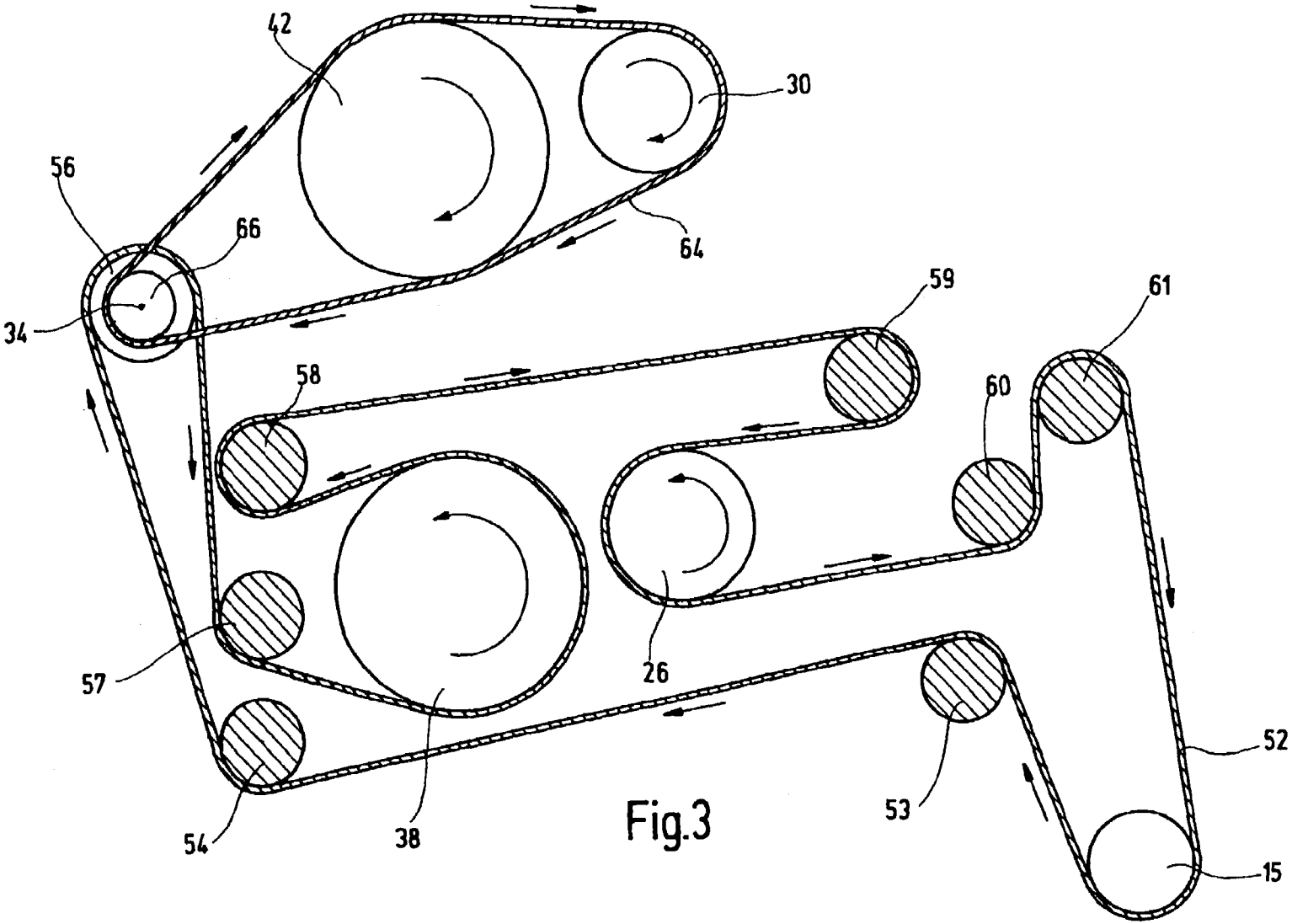
FIG. 3 shows, in highly schematic form, the drive of the pressing rollers.

FIG. 3 shows, in highly schematic form, the drive mechanism via which all four rotatably mounted pressing rollers can be driven, to be precise both in the operating state intended for pressing purposes, this being illustrated in FIG. 1, and in the operating state intended for cleaning purposes, this being illustrated in FIG. 2.

For this purpose, a first drive belt 52 is guided around a journal 15 of the drive mechanism 14.

In the drive direction, starting from the journal 15, the drive belt 52 is guided around a pair of deflecting rollers 53 and 54, and then around a first shaft 56, located along the pivot axis 34 of the pivotable lever 32.

The drive belt 52 is then guided around a further deflecting roller 57 to the drive journal of the third, lower pressing roller 38, runs around the latter and two further deflecting rollers 58, 59 and is then guided around the lateral journal of the first, lower pressing roller 26 and then, once it has run around a further pair of deflecting rollers 60 and 61, is fed back to the journal 15 of the drive motor of the drive mechanism 14.

A second drive belt 64 runs around a shaft 66, which runs coaxially with the first shaft 56 and is likewise located along the pivot axis 34 of the pivotable lever 32. This drive belt 64 runs around both the drive journal of the fourth, upper pressing roller 42 and the corresponding drive journal of the upper pressing roller 30, and is then fed back to the shaft 66.

It can be seen that the second drive belt 64 drives the two upper pressing rollers 30 and 42, which are supported by the pivotable lever 32, in any pivoting position of the pivotable lever 32.

A straightforward and compact drive mechanism is thus provided in order to drive all four pressing rollers in rotation in any desired operating state.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus for pressing sheet-like printed products to flat bodies, comprising:

a first pair of pressing rollers, having a first pressing roller and a second pressing roller, said sheet-like products passing between said first and said second rollers under pressure for pressing air between sheets of said sheet-like printing products;

at least a second pair of pressing rollers having a third pressing roller and a fourth pressing roller, said at least second pair of pressing rollers being arranged downstream of said first pair of rollers, such that said sheet-like printed products are pressed twice, first by said first pair of pressing rollers and consecutively by said second pair of pressing rollers; and a drive mechanism for driving said first and second pair of pressing rollers;

wherein one pressing roller of each pair of said first and second pairs of pressing rollers is movable away from, and toward, the respective other pressing roller via a mechanism to an extent that access for a cleaning process is achieved between each of said first and second pairs of pressing rollers;

wherein said pressing rollers which are movable away from, and toward, the respective other pressing rollers are supported by a pivotable lever, and further wherein said drive mechanism for driving said first and second pairs of pressing rollers has drive belts which are guided around pivoting journals of said pivotable lever.

2. The apparatus of claim 1, wherein the pressing rollers of each of said first and second pairs of pressing rollers are arranged one above the other, and wherein a respective upper pressing roller of each pair of said first and second pairs of pressing rollers is raised from a respective lower pressing roller via said mechanism.

3. The apparatus of claim 1, wherein the pressing rollers of each pair of said first and second pairs of pressing rollers which are movable away and toward the respective other pressing roller can be moved together via said mechanism.

4. The apparatus of claim 1, wherein said drive mechanism for driving said pressing rollers is designed such that said pressing rollers are driven both, when said movable pressing rollers have been moved away from the respective other pressing rollers and when they are butting against one another.

5. The apparatus of claim 1, wherein a first of said drive belts drives said respective other pressing rollers of said first and second pairs of pressing rollers, and wherein a second of said drive belts drives the pressing rollers of said first and second pairs of pressing rollers that are movable away and toward said respective other pressing rollers.

6. The apparatus of claim 1, wherein said respective other pressing rollers of each pair of said first and second pairs of pressing rollers are mounted in a resilient manner.

* * * * *